US005316827A

United States Patent [19]

Hill et al.

[11] Patent Number: 5,316,827

[45] Date of Patent: May 31, 1994

[54] CRIMPED TEXTILE FIBERS AND STUFFER BOX APPARATUS AND METHODS FOR CRIMPING TEXTILE FIBERS

[75] Inventors: Michael Hill, Ascot, England; Walter A. Nichols, Richmond, Va.

[73] Assignee: Filter Materials Limited, New York, N.Y.

[21] Appl. No.: 665,968

[22] Filed: Mar. 7, 1991

Related U.S. Application Data

[62] Division of Ser. No. 231,142, Aug. 10, 1988, Pat. No. 5,020,198.

[51] Int. Cl.[5] ..... D01D 5/22; D01D 5/42

[52] U.S. Cl. ..... 428/175; 428/111; 428/136; 428/225; 428/247; 428/252; 428/332; 264/25; 264/26

[58] Field of Search ..... 428/111, 136, 175, 225, 428/247, 252, 332; 264/147, 25, 26; 28/250; 130/332, 335, 343, 345

[56] References Cited

U.S. PATENT DOCUMENTS

| | | | |
|---|---|---|---|
| 3,226,795 | 1/1966 | Swerdloff et al. | 28/265 |
| 3,494,522 | 2/1970 | Kim et al. | 225/97 |
| 3,495,752 | 2/1970 | Kim et al. | 225/3 |
| 3,496,260 | 2/1970 | Gunether et al. | 264/156 |
| 3,500,517 | 3/1970 | Dekker et al. | 28/1.5 |
| 3,500,627 | 3/1970 | Kim | 57/140 |
| 3,526,349 | 9/1970 | Moro | 225/97 |
| 3,565,308 | 2/1971 | Slack | 225/97 |
| 3,566,735 | 3/1971 | Greene | 83/344 |
| 3,571,870 | 3/1971 | Dixon | 28/265 |
| 3,577,724 | 5/1971 | Greene | 57/157 |
| 3,595,454 | 7/1971 | Kalwaites | 225/3 |
| 3,726,079 | 4/1973 | Feild et al. | 57/155 |
| 3,739,053 | 6/1973 | Yazawa | 264/154 |
| 3,756,484 | 9/1973 | Guenther | 225/97 |
| 3,787,261 | 1/1974 | Heger et al. | 156/84 |
| 3,801,252 | 4/1974 | Waterhouse | 425/304 |
| 3,835,513 | 9/1974 | Stanley | 28/72.14 |
| 3,880,173 | 4/1975 | Hill | 131/269 |
| 3,883,936 | 5/1975 | Stanley | 28/72.14 |
| 3,927,957 | 12/1975 | Chill et al. | 425/131.1 |
| 3,955,255 | 5/1976 | Shields, Jr. | 28/1.6 |
| 3,985,600 | 10/1976 | Blais | 156/229 |
| 3,985,933 | 10/1976 | Mehta et al. | 428/357 |
| 4,129,632 | 12/1978 | Olson et al. | 264/40.1 |
| 4,134,951 | 1/1979 | Dow et al. | 264/147 |
| 4,316,730 | 2/1982 | Eibl | 131/203 |
| 4,707,896 | 11/1987 | Sowell | 28/250 |
| 4,854,021 | 8/1989 | Reinehr et al. | 28/263 |
| 4,925,602 | 5/1990 | Hill et al. | 264/25 |
| 5,025,815 | 6/1991 | Hill et al. | 131/332 |
| 5,104,367 | 4/1992 | Hill | 493/42 |

FOREIGN PATENT DOCUMENTS

| | | | |
|---|---|---|---|
| 7324417 | 7/1970 | Japan | 28/264 |
| 1207733 | 10/1970 | United Kingdom . | |
| 1301242 | of 1972 | United Kingdom | D02G 1/12 |
| 1260957 | 1/1972 | United Kingdom . | |
| 1339496 | 12/1973 | United Kingdom . | |
| 1442593 | 7/1976 | United Kingdom | B29D 7/00 |

OTHER PUBLICATIONS

Filter Materials Ltd. brochure, 1986.

*Primary Examiner*—Patrick J. Ryan
*Assistant Examiner*—Richard C. Weisberger
*Attorney, Agent, or Firm*—Jeffrey H. Ingerman; Elizabeth C. Schuler

[57] ABSTRACT

An improved stuffer box used for crimping textile fibers, particularly fibrillated polyolefin films. The width of the stuffer box is related to the linear density of the fiber bundles to be crimped whereby there is one millemeter of width for each fiber bunder size in the range of from about 200 to about 750 denier. Pressure controlled hinged lid or fixed lid exit orifices may be employed. Also employed may be a distributing device for applying additive material to the textile fibers prior to crimping to enhance the crimping operation or to enhance the end use of the crimped fiber or both. Fibrillated polyolefin materials that are crimped in accordance with the invention are adapted for use as filter materials in smoking articles.

4 Claims, 5 Drawing Sheets

CRIMPED TEXTILE FIBERS AND STUFFER BOX APPARATUS AND METHODS FOR CRIMPING TEXTILE FIBERS

RELATED APPLICATION

The present application is a divisional of application Ser. No. 07/231,142, filed Aug. 10, 1988, which issued as U.S. Pat. No. 5,020,198 on Jun. 4, 1991, entitled "Crimped Textile Fibers and Stuffer Box Apparatus and Methods for Crimping Textile Fibers."

BACKGROUND OF THE INVENTION

This invention relates to a method and apparatus for crimping textile fibers, and particularly to crimping fibrillated polyolefin materials for use as filter materials for tobacco-containing smoking articles.

Texturizing textile fibers, i.e., imparting a crimp into the fibers, using the "stuffer box" principle is well known. Crimping occurs by advancing the fiber at a given rate of speed into an enclosed box whereupon the fiber rapidly decelerates; hence the term stuffing. The stuffer box typically has either a lid that is hinged by one of a variety of techniques, or is fixed with a preset exit orifice, whereby when the box is filled with fiber and a certain predetermined pressure is achieved within the box, fibers will exude out; for example, when the pressure overcomes the forces holding the hinged lid closed, or, if the lid is fixed, when the pressure forces the fiber out the exit orifice.

The effect of the varying pressures inside the box is to impart crimps into the textile fibers. A primary crimp occurs when the the individual fibers obtain a wavy shape, for example, during rapid deceleration when the fibers hit the end wall of the stuffer box or the preceding crimped fiber. A secondary crimp occurs when the collapsed individual fibers begin to fold in on themselves inside the stuffer box.

Control of the pressure within the stuffer box is critical because it determines the regularity and nature of the primary crimp, i.e., the crimp frequency and amplitude. Generally, the frequency and amplitude are related so that as the frequency increases, the amplitude decreases. Control of the pressure is generally achieved by careful control of the movement of the hinged lid of the box, or by designing the fixed exit geometry of the box to known preset values such that the pressure drop across the box is known and gives the required fiber crimp characteristics.

Although the pressure exerted on the fibers by the hinged lid may be achieved by a variety of techniques, most commercially available systems employ a means of mechanically exerting pressure on the lid to preset values using pneumatic or hydraulic cylinders or actuators, or a known mass (weight) or masses.

Other factors that may affect the nature of the crimp achieved in the textured fiber include the overall geometry and volume of the box and surface frictional characteristics of the internal surfaces of the box, the diameter and surface characteristics of the feed rollers advancing and forcing the fibers into the box and the pressure with which these feed rollers are held together, the temperature of the box, the characteristics of the fibers being crimped and any pretreatment of the fibers. The characteristics of the fibers may vary with, for example, the chemical composition, fiber size and shape, fiber size distribution, number of fibers, and temperature. Pretreatment techniques may include, for example, thermal treatment or adding lubricants, antistatic finishes, oils, moisture, etc.

Conventional stuffer boxes embody a principle relating the width of the stuffer box to the total number of textile fibers or bundles in the tow to achieve desired crimp levels. Generally, for every millimeter of box width the fiber bundle to be crimped should have a size in the range of from about 1000 to about 1800 denier (hereinafter referred to as the "conventional rule"). Accordingly, for a fiber network having a total linear density of 40,000 denier, the stuffer box should have a width in the range of from about 22.2 mm to about 40.0 mm. Conventional equipment not complying with the conventional rule has been found to provide tows having unacceptable crimp characteristics.

It also is known to use fibrillated polyolefin films and form them into filter materials by forming them into a bloomed flocculated mass which is then formed into a filter rod by using conventional filter rod making equipment. These fibrillated polyolefin materials have an interconnected network of fibers and strands, including fibers connected to the network only at one point. These materials have been subjected to the conventional crimping process with some success.

However, one of the problems with the conventional stuffer boxes for crimping fibrillated polyolefin tow is that the crimp amplitude and frequency has not been sufficient to impart adequate filtration capabilities into such materials when formed into filter rods in a conventional manner.

Notwithstanding years of development efforts, there is no commercial use of a filter for smoking articles comprising a fibrillated polyolefin material that provides the advantages and benefits associated with conventional cellulose acetate filter materials used in smoking articles, and particularly, tobacco-containing cigarettes.

Accordingly, there is a continuing need for apparatus and methods for processing fibrillated polyolefin materials to produce filter materials appropriate for use in smoking articles that is more effective, and easier and cheaper to manufacture and form into filters than conventional cellulose acetate materials.

SUMMARY OF THE INVENTION

It is an object of this invention to provide an improved stuffer box for imparting crimps into a tow of textile fibers to provide an increased number of crimps per inch in the tow material. It is another object to provide a crimped textile material, including but not limited to fibrillated polyolefin films, having an increased number of crimps per inch.

It is another object of this invention to provide an improved stuffer box for imparting crimps into a tow of fibrillated polyolefin materials that can be adapted for forming into filter rods for use in smoking articles. It is another object to provide additives prior to crimping such materials to improve the smoking and taste characteristics of such filter rods.

It is another object of this invention to provide improved processing of fibrillated polyolefin film tow for forming crimps in the tow.

In accordance with the present invention, there is provided a stuffer box having a configuration that differs significantly from the conventional rule and provides crimped fiber bundles that have the acceptable crimp characteristics suitable for use in the manufacture of textured fibers for conventional purposes. Broadly, the invention comprises a stuffer box having an entry width whereby there is one millimeter of width for each fiber bundle size of about 200 to about 750 denier, more preferably about 500 denier.

The stuffer box is preferably configured with a hinged lid wherein the hinge is a self-exhausting pneumatic cylinder adapted for urging the lid closed. Conventional feed rollers for advancing the fibers and exerting pressure on the fibers may be used to feed the textile fibers into the stuffer box. Means for cooling the feed rollers with, e.g., water, compressed air, may be provided.

The stuffer box of the present invention is particularly applicable for processing textile fiber filaments interconnected in a network configuration or fiber filaments interconnected in the main on a network configuration but having some fibers connected into the network by one connection point only, or an interconnected network of fiber having discrete fibers of the same kind or different (i.e., chemically different, different in size or geometry) enmeshed in the main fiber network, or an interconnected network of fibers having discrete inclusion of additives separate to or coating the fibers comprising the network, or any combination of the above. More particularly, the stuffer box of the present invention is adapted for texturizing fibrillated polyolefin fibers of the type described in U.S. Pat. No. 3,880,173, its corresponding U.K Patent 442,593, or commonly assigned U.S. application Ser. No. 07/231,144, filed on Aug. 10, 1998, now abandoned in favor of U.S. patent application Ser. No. 07/617,395, filed on Nov. 20, 1990, now U.S. Pat. No. 5,020,148, the disclosures of which are hereby incorporated by reference.

In accordance with another aspect of the invention, there is provided a method for processing the foregoing fibers by adding one of a variety of chemical additives applied prior to subjecting the fibers to the stuffer box of the present invention to enhance the resultant range of final texturized properties of the fibers. Such additives also may be used to influence smoke and taste characteristics when the texturized fiber tow is used in filter tow applications, particularly for tobacco-containing cigarettes. Such additives may be selected from among the group consisting of oils, fatty acid esters, waxes, esters of alcohols, ionic and non ionic surfactants, or blends of the same.

The present invention permits the crimping of interconnected fibrous networks of fiber to levels desirable to facilitate the manufacture of cigarette filter tow and further confers the ability to influence subjective responses on cigarettes fitted with filter rods made from the treated crimped fiber tow. The present invention further provides for imparting a higher crimp frequency than is obtainable from conventional apparatus.

The improved nature of the resultant crimped fiber tow is observed from the crimp frequency and amplitude, wherein the crimp frequency is defined as the number of complete adjacent peaks and troughs per unit length, in units of cycles per inch, and the crimp amplitude is defined as the total vertical distance between adjacent peaks and troughs in the crimped fiber.

The improvement is further observed from the improved Tow Yields for fibrillated polyolefin materials made by the present invention that are formed into filter lengths using conventional filter rod making equipment such as that used for forming cellulose acetate tow into filter materials. Tow Yields are obtained from the following expression:

$$\text{Tow Yield} = \frac{\text{Pressure drop (mm WG)}}{\text{Net Weight of Fiber in rod (mg)}} \times 100\%.$$

The Net Weight is measured in units of milligrams for a given length of filter rod. The pressure drop is measured in millimeters of Water Gauge at an airflow flow of 1,050 ml per minute through the net weight of rod. Higher Tow Yields correspond to more randomly dispersed free ends and an improved fibrous strand network and, hence, a more efficient use of the polyolefin materials.

BRIEF DESCRIPTION OF THE DRAWINGS

The above and other objects and advantages of the invention will be apparent upon consideration of the following detailed description, taken in consideration with the accompanying drawings, in which like reference characters refer to like parts throughout, and in which.

DETAILED DESCRIPTION OF THE INVENTION

Figure 1:
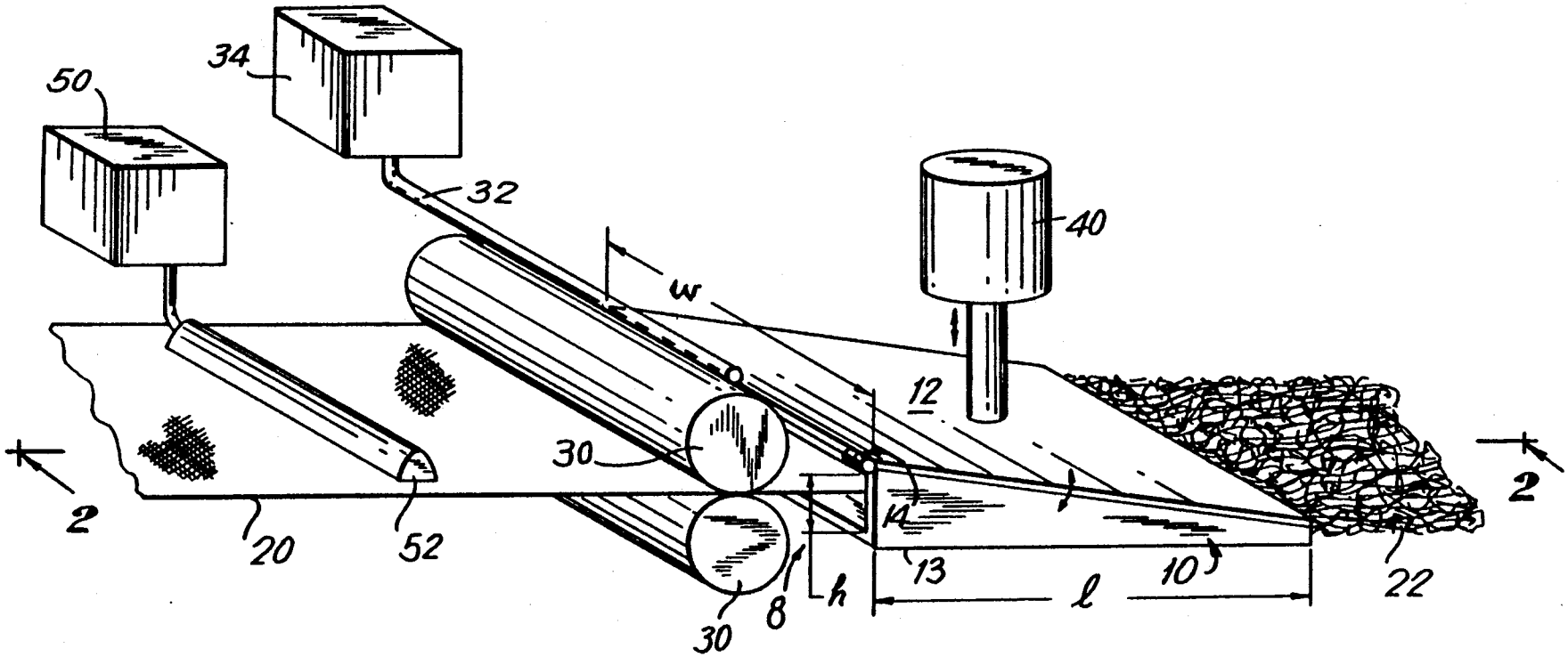
FIG. 1 is an elevated perspective view of a stuffer box in accordance with an embodiment of the present invention.
Figure 2:
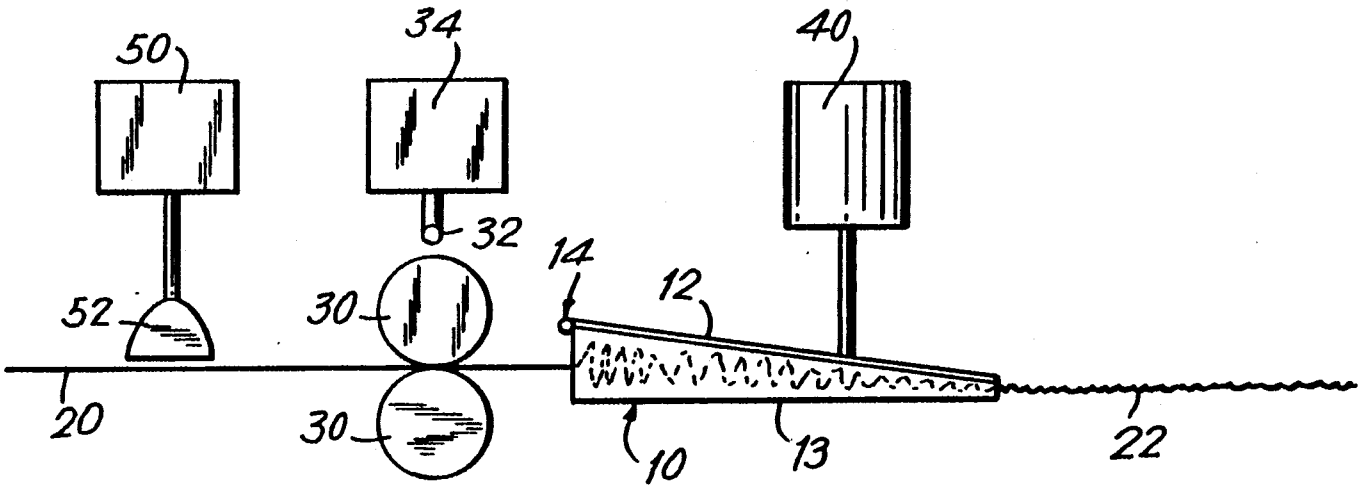
FIG. 2 is a side view taken along line 2—2 of FIG. 1.
Figure 3:
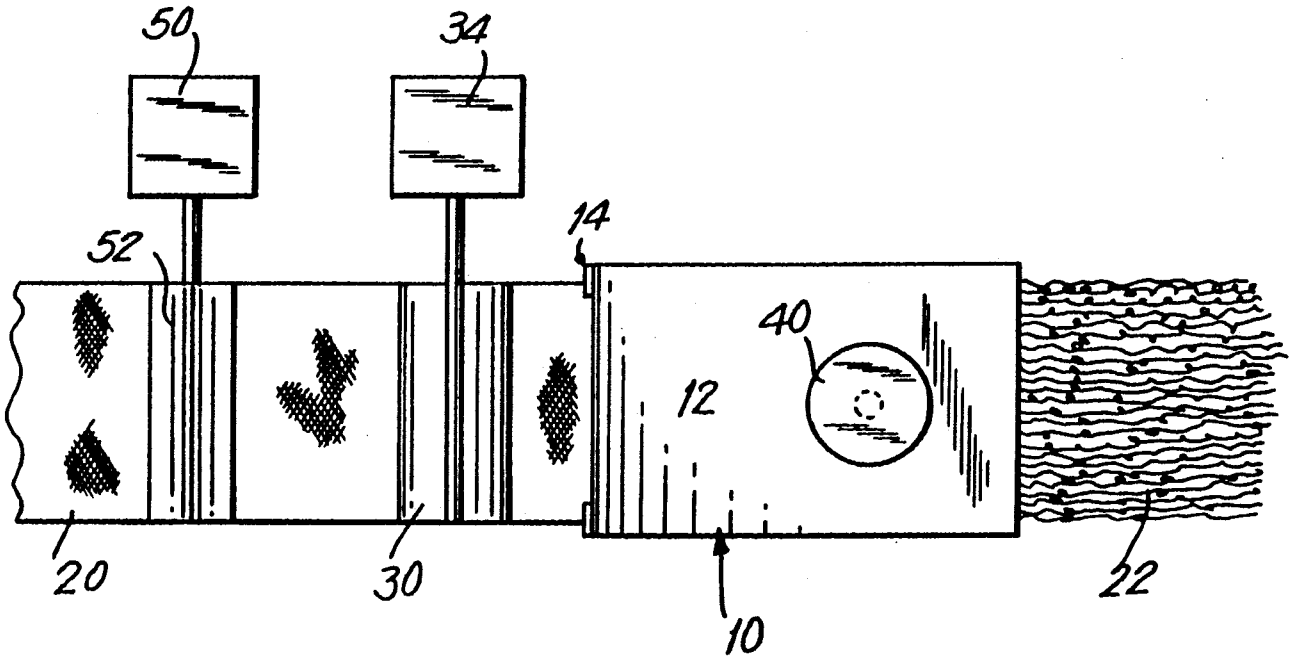
FIG. 3 is a top view of FIG. 1.

As shown in FIGS. 1–3, and 5, illustrative embodiments of this invention include stuffer box 10 adapted for imparting crimps to textile material 20 thereby forming crimped textile material 22. Associated with stuffer box 20 are feed rollers 30 which advance material 20 into opening 8 of stuffer box 10. Feed rollers 30 may be urged together with a loading sufficient to maintain frictional contact with material 20 and thereby advance material 20 into opening 8 of box 10. For example, pneumatic cylinders may be used to exert a force of from about 0.1 to about 5 bars to urge the rollers together. Feed rollers are preferably of about the same dimensions and are about the same width as opening 8 of box 10, although there may be some differences, for example, upper roller 30 being about the same width as opening 8 and lower roller 30 being somewhat wider than opening 8.

Feed rollers 30 also may have an associated cooling mechanism which may be a source of compressed air 34 and vents 32 directed to one or both of feeding rollers 30 (only one vent shown in the Figs.). Other sources of cooling feed rollers 30 that will not adversely affect textile material 20 for its intended uses may be used, e.g., water, oil, refrigerated air and the like.

Stuffer box 10 further includes lid 12 which is connected to box 10 at hinge 14, base 13 and self-exhausting pneumatic cylinder 40 which is capable of exerting a selectable level of force so that when that level of force is overcome, the cylinder will collapse and translate. Thus, hinged lid 12 is maintained urged closed by cylinder 40 which is adjusted to exert on lid 12 the preselected level of force for the particular crimping operation on the given textile fiber. For example, and with reference to Examples 3–9, predetermined threshhold forces in a range of from about 1.0 kgf to about 50 kgf may be used.

Optionally, source of additive 50 and distribution means 52 may be provided at an appropriate location, e.g, prior to or subsequent to feed rollers 30 (only the former is shown in the Figs.). Distribution means 52 includes a metering means for controlling the rate of application of the additive to the textile material 20.

Stuffer box 10 has entry width w, entry height h, and length l, that are selected for the given linear density of the textile material as are described above and below in connection with the Examples. The exit width is typically about the same as the entry width and the exit height for a hinged lid stuffer box is dependent upon the desired pressures to be generated inside the stuffer box and the force selected for cylinder 40. Such heights are generally a fraction of the entry height, e.g., 63%.

Figure 4:
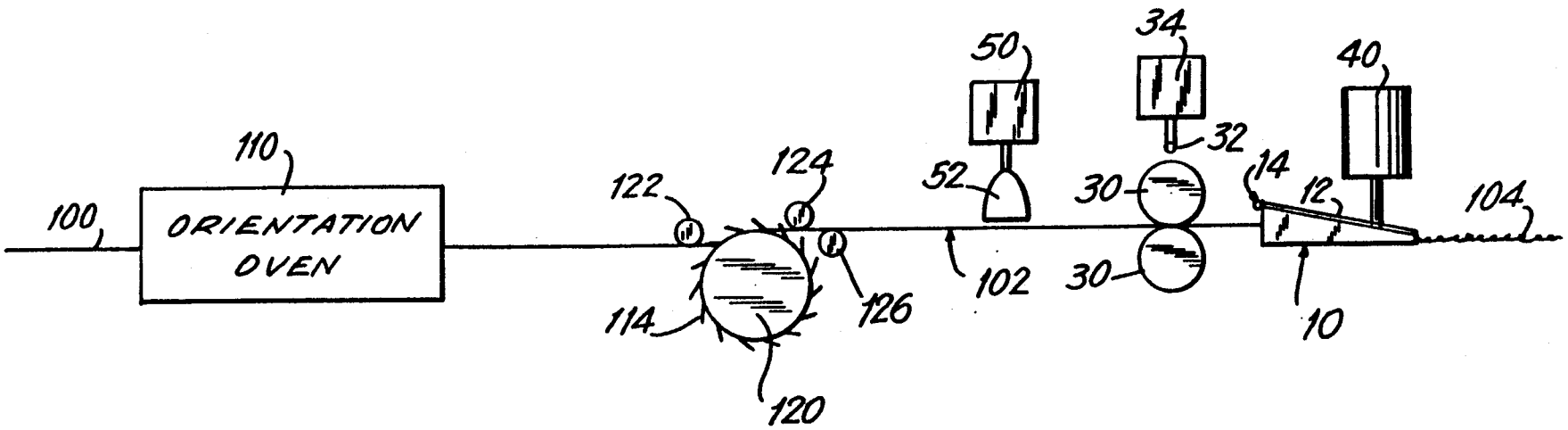
FIG. 4 is an illustrative schematic view of a fibrillation apparatus incorporating the stuffer box of the present invention.

Referring to FIG. 4, unfibrillated polyolefin film 100 is passed through orientation oven 110 and then over pinned roller 120 having a plurality of rows 114 of pins (not shown) spaced about the circumference of roller 120, thereby providing fibrillated film 102. Fibrillated film 102 is then passed under additive distribution means 52 and between feed rollers 30 and into stuffer box 10 for the crimping operation in accordance with the present invention.

Figure 5:
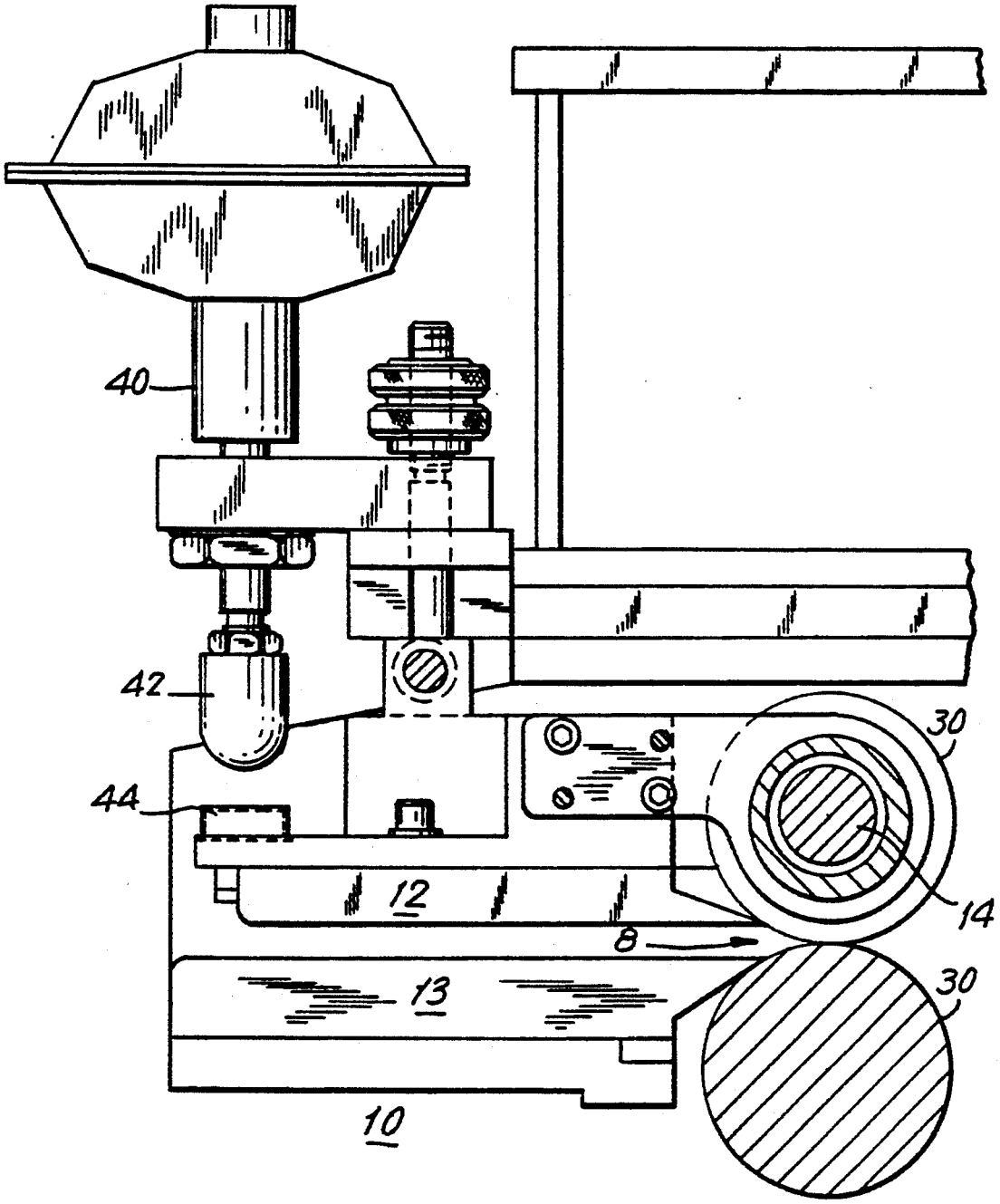
FIG. 5 is a schematic cross sectional side view of a stuffer box in accordance with an embodiment of the present invention.

Referring to FIG. 5, stuffer box 10 comprises base 13, opening 8, lid 12, and hinge 14. Hinge 14 is integral with upper roller 30 and is shown in its upper and unloaded condition. Cylinder 40 has extension arm 42 which is in an unloaded condition. When cylinder 40 is actuated, arm 42 will extend downwardly and contact receptacle 44 which will cause lid 12 to rotate about hinge 14 until lid 12 contacts base 13. When material 20 (not shown in FIG. 5) is advanced into box 10 and the pressure risen above the predetermined threshold force exerted by cylinder 40, lid 12 will rotate upwardly and release crimped material 22 (not shown in FIG. 5).

The method and apparatus of the present invention is further described in connection with the following examples.

EXAMPLES

Each of following examples were prepared from following blend of polyolefin materials:

92% polyproplyene homopolymer, melt index 1.8 (230° C., 2.16 kgf)

7% low density polyethylene, melt index 1.0 (190° C., 2.16 kgf)

1% polypropylene (of the same type as above) masterbatch, containing 25% titanium dioxide (rutile grade, fine crystal structure, micronized grade).

These materials were mixed and extruded using a known blown film technique to produce a film of 35 μ thickness. This film was then slit into six portions of substantially equal width, stacked, and oriented in a longitudinal direction with a stretch ratio of 8:1 to produce films of 12.4 μ thickness. The oriented films were then passed around part of the periphery of a pinned fibrillating roller passed into a stuffer box in accordance with the present invention for the texturizing operation for crimping the fibrillated film.

In each example, the pinned roller used had a diameter of 190 mm at the roller surface, and the angle of rake of the pins was 60 degrees (relative to the tangent). There were 180 lines of pins in paired rows to form 90 double rows of pins in a space-staggered relationship and the pin diameter was 0.4826 mm. The pins had a pin projection length of about 1.0 mm, the pin projection length being measured from the pin tip to the roll surface in a plane passing through the roll axis. The double rows extended across the roller having a chevron pattern.

The configuration of the stuffer box and the processing parameters for the texturizing operation, and the resulting crimp parameters are set forth in Table I.

TABLE I

PROCESSING PARAMETERS

| | Examples | | | | | | | | |
|---|---|---|---|---|---|---|---|---|---|
| Parameters | Ex. 1 | Ex. 2 | Ex. 3 | Ex. 4 | Ex. 5 | Ex. 6 | Ex. 7 | Ex. 8 | Ex. 9 |
| Total Tow Denier | 38,000 | 60,000 | 36,000 | 40,000 | 40,000 | 40,000 | 41,000 | 38,000 | 36,500 |
| Input Speed of Tow (m/min) | 138 | 60 | 138 | 138 | 138 | 138 | 138 | 138 | 138 |
| Stuffer Box Width (mm) | 80 | 40 | 80 | 80 | 80 | 80 | 80 | 80 | 101.6 |
| Stuffer Box Entry Height (mm) | 20 | 12 | 4 | 4 | 4 | 4 | 4 | 8 | 20 |
| Stuffer Box Length (mm) | 175 | 160 | 165 | 165 | 165 | 165 | 165 | 175 | 130 |
| Pressure on Hinged Lid of Stuffer Box (kgf) | 10 | 0.8 bar | 10 | 15 | 12.5 | 12 | 15 | 0.5 BAR applied to top and bottom surfaces | 10 |
| Pressure on Feed Rollers of Stuffer Box (bar) | 2 | 2.5 | 3 | 3 | 3 | 3 | 3 | 3 | |
| Feed Roller Diameter (mm) | 80 | 200 | 80 | 80 | 80 | 80 | 80 | 150 | 80 |
| Box Temperature (°C.) | 40 | 20 | 60 | 60 | 60 | 60 | 60 | Ambient | 40 |
| Box Material | Brass | Stainless Steel | Stainless Steel | Stainless Steel | Stainless Steel | Stainless Steel | Stainless Steel | Stainless Steel | Brass |
| Feeder Roller Cooling | None | Water 10 L/min | Air 10 L/min @ 2 bar | Air 10 L/min @ 2 bar | Air 10 L/min @ 2 bar | Air 10 L/min @ 2 bar | Air 10 L/min @ 2 bar | Water 10 L/min | None |
| Additives Applied | None | None | Deionized | Poly- | Glyceral | Blend of | PoE | Poly- | Deionised |

TABLE I-continued

| Parameters | PROCESSING PARAMETERS Examples Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| To Tow Prior To Crimping | | | Water 20 ml/min | glycol Ester** 20 ml/min | Tri-acetate ($C_9H_{14}O_6$), 30 ml/min | fatty acid ester and mineral oil Cirrasol*** 20 ml/min | Sorbitan Mono-sterate*** 20 ml/min | glycol Ester** 40 ml/min | water; 20 ml/min |
| Mean Crimp Frequency (cpi) | 14.9 | * | 58.4 | 54.5 | 52.8 | 58.2 | 43.2 | 57.7 | 21.4 |
| Mean Crimp Amplitude (μ) | 592 | * | 360 | 382 | 380 | 344 | 428 | 320 | 512 |

*Could not be determined without destroying the nature of the crimp; tow exiting the box contained welded bands of fiber that could not be separated for making measurements.
**Brand name LW1177, available from Henkel-Nopco, Ltd., Nopco House, Kirkstall Road, Leeds, England.
***Brand name Tween 21, available from ICI Speciality Chemicals, Cleeve Road, Leatherhead, Surry, England.
****Brand name DS5676, available from ICI Speciality Chemicals, Cleeve Road, Leatherhead, Surry, England.

The fibrillated material was then formed into a filter rod using conventional filter rod forming apparatus for example, model KDF-2 manufactured by Hauni Werke Korber & Co., Hamburg, Germany, wherein the tow is formed into a bloomed flocculent mass having the identified crimp characteristics, and processed by the filter making apparatus into a rod having a circumference of 24.55 mm and a length of 66 mm. Other filter dimension could be obtained.

The results of the evaluation of the filter material constructed from the fibrillated material of the examples are set forth in Table II. The low yield and high yield values respectively correspond to the minimum point and the maximum point on the capability curve, which curve compares relative pressure drop for changes in the net weight of tow material in a uniformly dimensioned filter rod. All of Examples 3–9 provided a tow yield that reflected a significant improvement over the crimped fibrillated polyolefin filter rods obtained by prior known devices as in Examples 1 and 2 and over conventional cellulose acetate filters.

TABLE II

| | TOW YIELDS Ex. 1* | Ex. 2** | Ex. 3 | Ex. 4 | Ex. 5 | Ex. 6 | Ex. 7 | Ex. 8* | Ex. 9 |
|---|---|---|---|---|---|---|---|---|---|
| LOW YIELD | | | | | | | | | |
| Mean Pressure Drop (mmWG) | 141 | | 219 | 252 | 300.5 | 267 | 265.5 | 221 | 188 |
| Net Weight of Rod (mg) | 323 | | 300 | 327 | 261.5 | 305 | 343 | 313 | 286 |
| Yield (%) | 44 | | 73 | 77 | 83 | 68 | 77 | 71 | 66 |
| HIGH YIELD | | | | | | | | | |
| Mean Pressure Drop (mmWG) | | | 268 | 339 | 376 | 264 | 353.5 | | 262 |
| Net Weight of Rod (mg) | | | 333 | 371 | 396.2 | 341 | 386 | | 334 |
| Yield (%) | | | 80 | 91 | 95 | 77 | 91 | | 78 |

*Data represents an overall view of the low and high yield points on the capability curve.
**No data obtained.

The crimper box of Example 1 was wider than the width dictated by the conventional rule, had a high box entry height and a standard roller diameter, had no additives or roller cooling, and produced a tow characterized by low yields, low crimp frequency and high crimp amplitude, and shows the effect of and indicates the benefit of the application of additives to the fiber prior to crimping. The crimper box of Example 2 was constructed to a width dictated by the conventional rule, had a medium box entry height, a large roller diameter and roller cooling, but did not have additives, and produced a tow having fused sections which is useless for smoke filtering applications.

The crimper boxes of Examples 3–9 constructed in accordance with various embodiments of the present invention, had wider widths than the width dictated by the conventional rule and the other parameters as set forth in Table I, and produced rows characterized by a high crimp frequency, a low crimp amplitude and high tow yields suitable for use as filter materials in smoking.

One skilled in the art will appreciate that the present invention can be practiced by other than the described embodiments, which are presented for purposes of illustration and not of limitation, and the present invention is limited only by the claims which follow.

We claim:

1. An interconnected mass of crimped textile fibers having a mean crimp frequency of from about 43 to about 60 crimps per inch and a mean crimp amplitude of from about 320 to about 430 microns.

2. The interconnected mass of crimped textile fibers of claim 1 wherein said interconnected mass of textile fibers is a fibrillated polyolefin film.

3. The interconnected mass of crimped textile fibers of claim 2, wherein said fibrillated polyolefin film comprises 92 wt. % polyproplene, 7 wt. % polyethylene, and 1 wt. % of a masterbatch comprising one of either of polypropylene or polyethylene and a filler material selected from among the group consisting of titanium dioxide, calcium carbonate, and carbon black.

4. The interconnected mass of crimped textile fibers of claim 2, wherein the crimps extend across the width of said mass of fibers perpendicular to the fibrillation direction.

* * * * *